US006239549B1

(12) United States Patent
Laprade

(10) Patent No.: US 6,239,549 B1
(45) **Date of Patent: *May 29, 2001**

(54) ELECTRON MULTIPLIER ELECTRON SOURCE AND IONIZATION SOURCE USING IT

(75) Inventor: Bruce Laprade, Holland, MA (US)

(73) Assignee: Burle Technologies, Inc., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,911

(22) Filed: Jan. 9, 1998

(51) Int. Cl.[7] ..... H01J 43/18

(52) U.S. Cl. ..... 313/533; 313/532; 313/534; 313/535; 313/536

(58) Field of Search ..... 313/532, 533, 313/534, 535, 536, 103 R, 103 CM

(56) References Cited

U.S. PATENT DOCUMENTS

| | | | | |
|---|---|---|---|---|
| 2,150,317 | | 3/1939 | Clark . | |
| 2,586,771 | | 2/1952 | Arditi et al. . | |
| 2,802,127 | | 8/1957 | Dobischek et al. . | |
| 2,810,075 | | 10/1957 | Hall et al. . | |
| 3,171,024 | | 2/1965 | Smith . | |
| 3,221,164 | | 11/1965 | Günther . | |
| 3,586,853 | | 6/1971 | Vestal . | |
| 3,663,810 | | 5/1972 | Cone . | |
| 3,854,066 | | 12/1974 | Payne . | |
| 3,904,923 | * | 9/1975 | Schwartz | 313/105 R |
| 4,099,079 | | 7/1978 | Knapp . | |
| 4,240,007 | | 12/1980 | Dreyfus et al. . | |
| 4,298,817 | | 11/1981 | Carette et al. . | |
| 4,737,623 | | 4/1988 | Uhl . | |
| 4,978,885 | | 12/1990 | White et al. . | |
| 5,108,961 | * | 4/1992 | Zhong et al. | 313/105 R |
| 5,132,586 | | 7/1992 | Boulais et al. . | |
| 5,463,218 | | 10/1995 | Holle . | |
| 5,656,807 | * | 8/1997 | Packard | 313/105 R |
| 5,656,887 | * | 8/1997 | Voshell et al. | 313/103 CM |
| 5,729,244 | * | 3/1998 | Lockwood | 313/309 |
| 5,751,109 | * | 5/1998 | Payne | 313/103 CM |

OTHER PUBLICATIONS

Exhibit Book for U.S. Patent Appln. Serial No. 317,977, filed Mar. 2, 1989 (Paul L. White et al., applicants), for "Electron Multipliers with Reduced Ion Feedback".

Timothy, J. Gethyn, Mount, George H., and Bybee, Richard L., "Multi–Anode Microchannel Arrays", *SPIE* vol. 190 LASL Optics Conference (1979), pp. 360–368.

Timothy, J. Gethyn, "Curved–Channel Microchannel Array Plates", *Rev. Sci. Instrum.* vol. 52 No. 8, Aug. 1981, pp. 1131–1142.

Timothy, J. G., "Preliminary Results with Microchannel Array Plates Employing Curved Microchannels to Inhibit Ion Feedback", *Rev. Sci. Instrum.* vol. 48, No. 3, Mar. 1977, pp. 292–299.

* cited by examiner

*Primary Examiner*—Vip Patel
(74) *Attorney, Agent, or Firm*—Dykema Gossett PLLC

(57) ABSTRACT

An electron multiplier with a source for spontaneously generating electrons is used as an electron source for an ionization source in a mass spectrometer or the like. The electron multiplier can be a microchannel plate, in which case it produces a wide electron beam. The microchannel plate can be acid-leached to provide a surface for spontaneous generation of electrons, or the first strike surface can be coated with an alkali-containing material. The electron source can be tuned by providing an electrode for rejecting electrons having too high an energy and a grid for rejecting electrons having too low an energy.

19 Claims, 6 Drawing Sheets

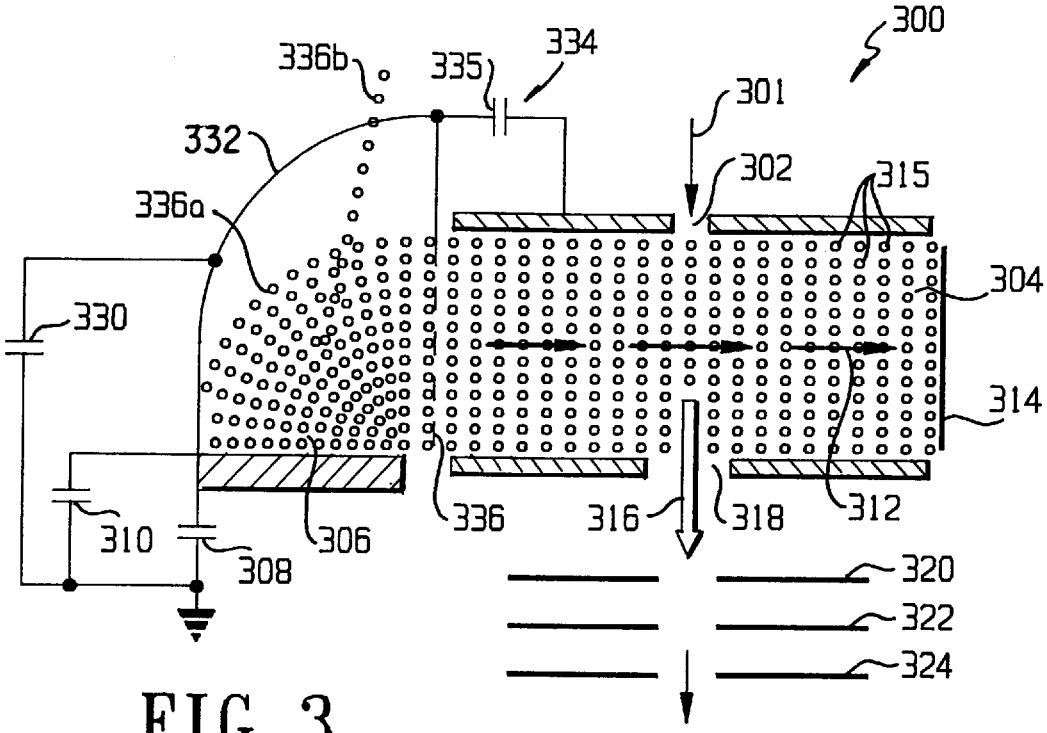
FIG.3
FIG.5
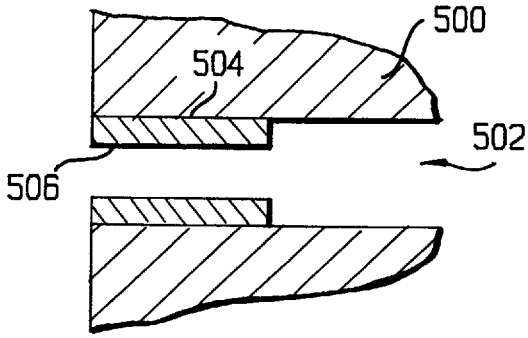
FIG.6
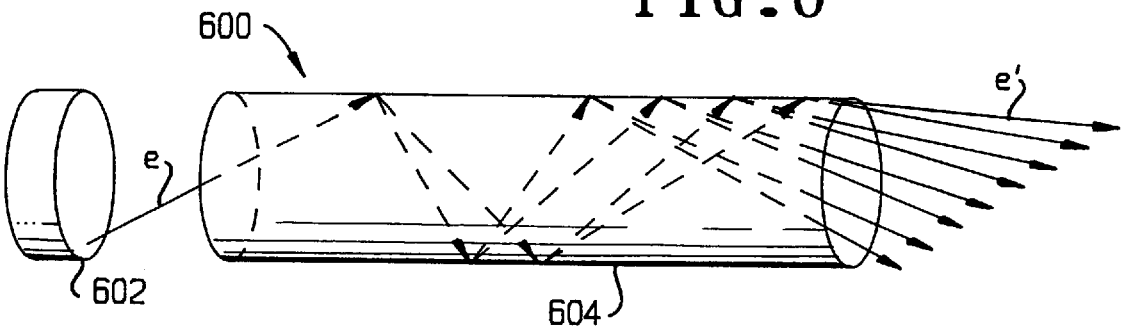

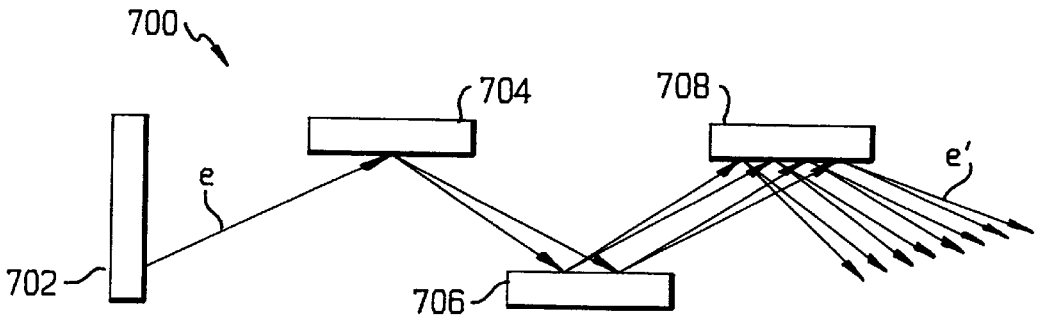
FIG. 7
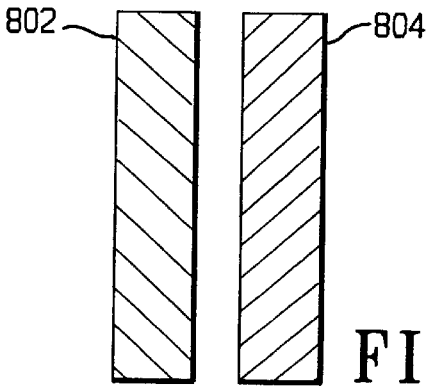
FIG. 8
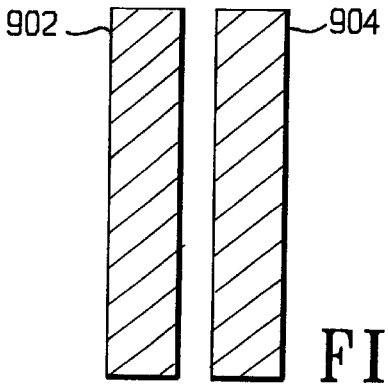
FIG. 9
FIG. 10
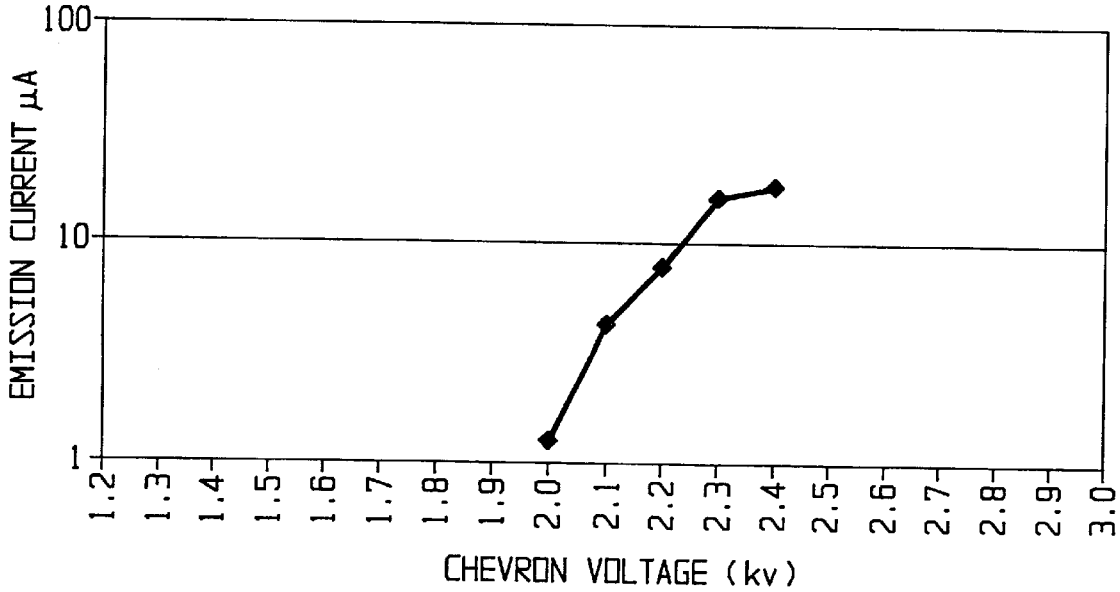

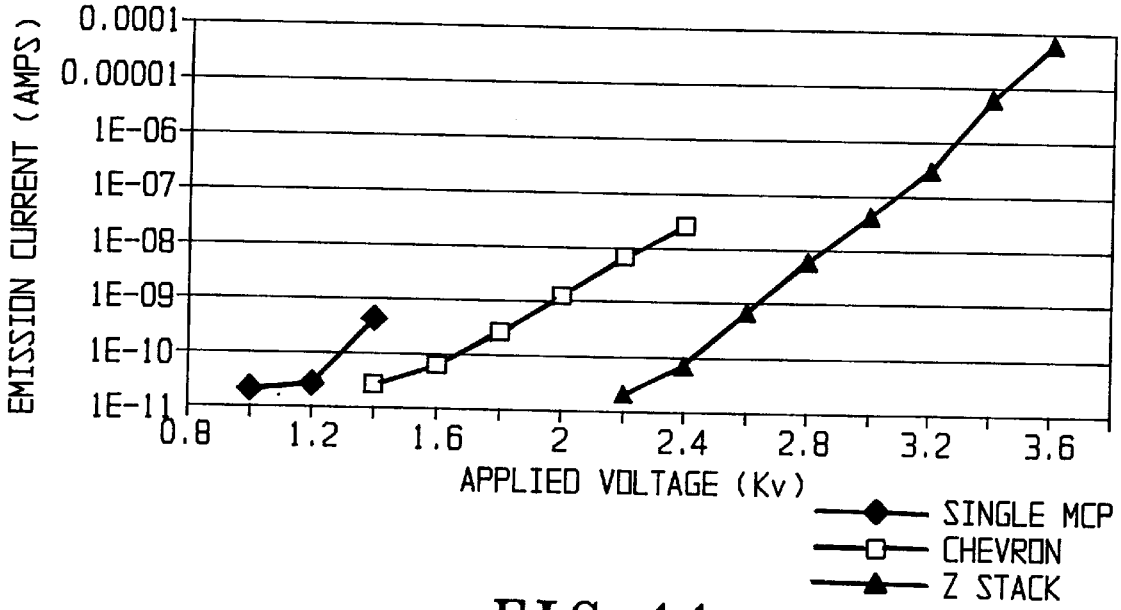
FIG. 11
FIG. 12
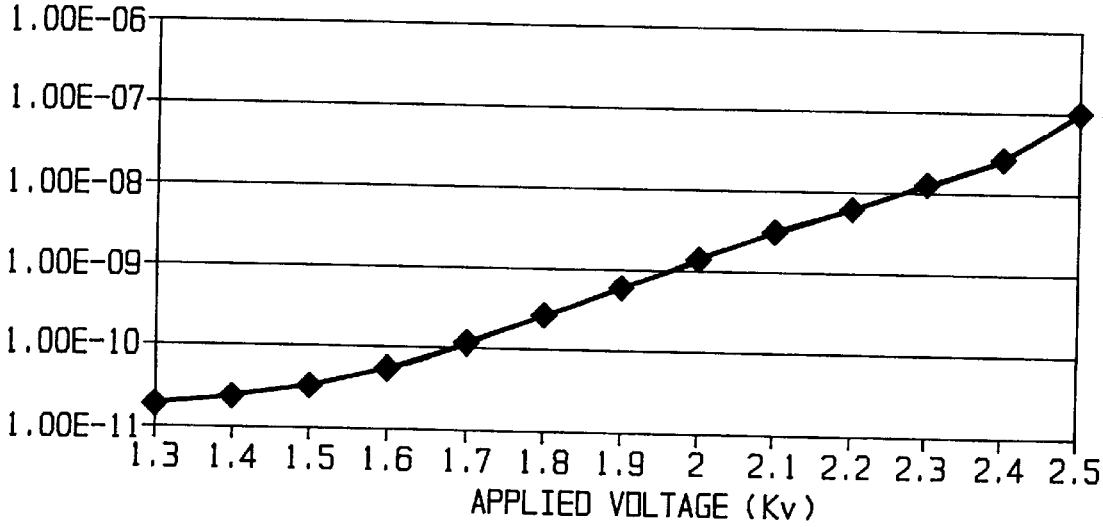

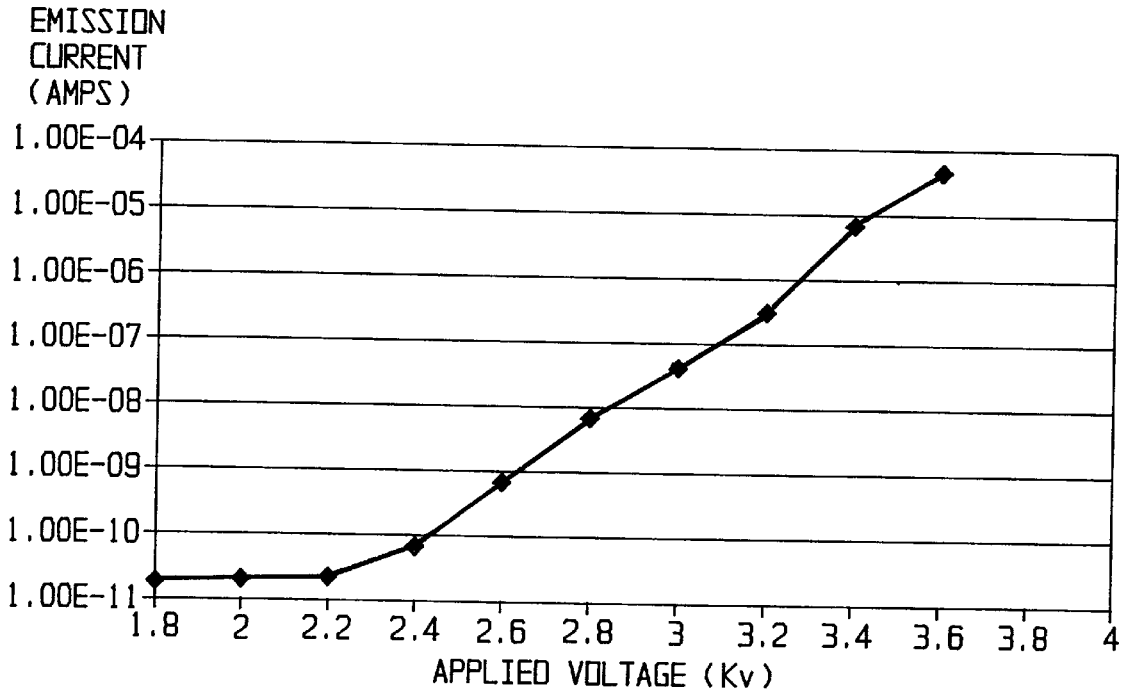
FIG. 13
FIG. 16
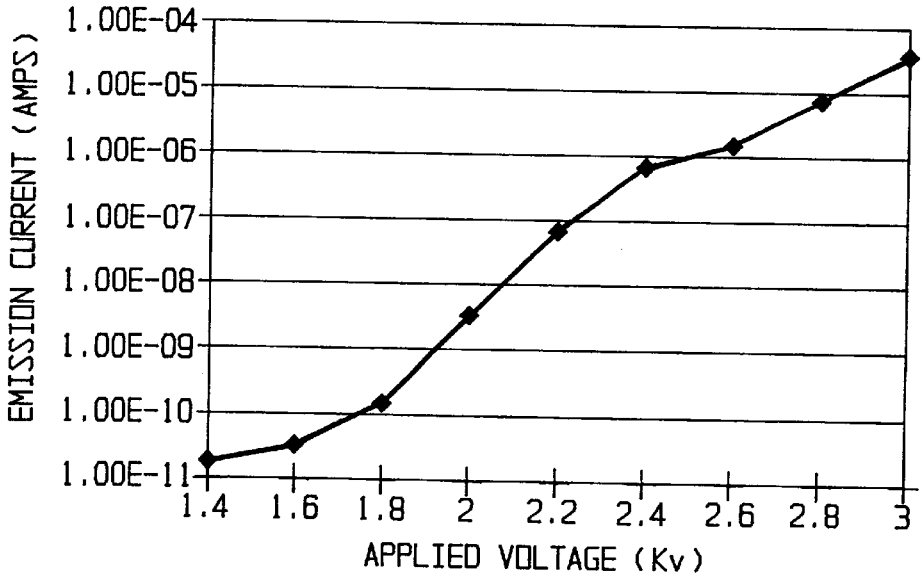

ELECTRON MULTIPLIER ELECTRON SOURCE AND IONIZATION SOURCE USING IT

FIELD OF THE INVENTION

The present invention is directed to an ionization source for mass spectrometry or the like and to an electron source for such an ionization source.

DESCRIPTION OF RELATED ART

Analytical instrumentation is playing an expanded role in everyday life. Expanding applications include quality control, drug discovery, and medical diagnostics.

Mass spectrometers are one of the most useful analytical instruments in use today. These devices provide compositional and structural information of unknown materials. The use of these instruments was originally limited to highly educated, specialized chemists known as mass spectroscopists. However, with the advent of low-cost computers with large memory capacity, a new generation of computer-controlled instruments, intended to be used by non-chemists, is now available. The use of on-board library spectra matching and identification has now enabled a whole new generation of non-technical professionals to benefit from the capabilities of these instruments. User-friendly instruments continue to expand the use of mass spectrometry into non-traditional market areas; indeed, a well-known restaurant chain now uses a mass spectrometer to check the quality of seafood before it is served.

Mass spectrometer instruments include three basic parts: the ionization source, the mass filter, and the detector. The ionization source converts neutral molecules to be identified into ions. The mass filter separates the unknown ions from other ions in accordance with mass. The detector detects the ions by their mass and provides an amplified output signal, typically proportional to the abundance of the material present.

More specifically, the function of the ionization source is to apply a net charge to the neutral molecule which is to be identified. Ionization of a molecule is accomplished by adding electrons to the molecule or more often by subtracting electrons from the molecule. There are four common ionization techniques: electron impact, chemical ionization, field ionization, and photo ionization.

The efficiency with which molecules are ionized in mass spectrometers is low, typically under 1% for electron impact ionization. Low ionization efficiency directly translates to low instrument sensitivity. Currently all instruments utilizing electron impact ionization rely on a thin wire filament (similar to that found in a light bulb) heated to a high temperature to produce electrons. These filaments produce a narrow stream of electrons which upon collision with a molecule may produce an ion.

FIG. 1 illustrates the typical filament-based ionization source employed in a current mass spectrometer. The narrow beam produced by the filament provided a relatively small area in which ions can be produced.

As shown in FIG. 1, in typical filament-based ionization source 100, the material to be ionized is introduced via gaseous sample inlet 102 to ionization space 104. Cathodic filament electron emitter 106, supplied with filament heater potential 108 and electron accelerating potential 110, emits a beam of electrons along electron trajectory 112 to electron discharge anode 114. The beam of electrons ionizes the material to produce ion beam 116 which exits ionization space 104 through ion exit port 118. Ion beam 116 passes through extracting lens 120, focusing lens 122 and accelerating lens 124 to the analyzer.

Conventional filament-based ionization sources have many performance disadvantages. They have a short life, typically 90 days. Heat generated by the filament can affect the chemistry of the molecule being identified. Filaments are unstable and require a warm-up period. Typical sources provide a narrow beam for collisions with molecules to be ionized.

Conventional electron multiplier fabrication and processing techniques are designed to reduce or eliminate spontaneous electron emission, which is seen as noise and a reduction in the signal-to-noise ratio of the device. Most manufacturing processes are designed with priority given to producing smooth emissive surfaces with high dielectric integrity and freedom from physical imperfections which may be conducive to field emission. Variations in the standard manufacturing processes, which induce microfractures, sharp edges, or other surface imperfections, are considered undesirable in conventional electron multiplier manufacture. An example of a conventional electron multiplier is the microchannel plate (MCP) of U.S. Pat. No. 4,978,885, issued Dec. 18, 1990, to White and Laprade. The patent to White et al teaches the importance of minimizing ion feedback to provide an MCP with quiet operation.

SUMMARY OF THE INVENTION

An object of the invention is to provide an ionization source which overcomes the above-noted disadvantages.

A further object of the invention is to provide a cold ionization source.

A further object of the invention is to provide an ionization source having a large emission area.

A further object of the invention is to provide an ionization source having a high-density, uniform emission pattern.

A further object of the invention is to provide an ionization source which is durable and which will not burn out.

A further object of the invention is to provide a low-maintenance ionization source which uses cold ionization and therefore does not require frequent cleaning.

A further object of the invention is to provide an ionization source which does not require a warm-up/stabilization time.

A further object of the invention is to provide an ionization source with fine emission level control.

A further object of the invention is to provide an electron source which makes such an ionization source possible by not requiring a primary source to initiate emission and by not being limited to operation in the unstable ion feedback mode.

To achieve these and other objects, the present invention is directed to an electron source comprising: a generating portion for spontaneously generating electrons; and an electron multiplying portion, receiving the electrons spontaneously generated by the generating portion, for multiplying the electrons to produce an electron beam.

The present invention is further directed to a method of making an electron source, the method comprising the following steps: (a) forming an electron multiplier, and (b) treating the electron multiplier so that at least a portion of the electron multiplier spontaneously generates electrons.

The invention is further directed to an ionization source comprising: an electron source including electron generating and multiplying portions for spontaneously generating electrons and multiplying the electrons to produce an electron beam; an ionization space disposed to receive the electron beam from the electron source, the ionization space having (i) an inlet for receiving a material to be ionized so that the material to be ionized passes through the electron beam to produce ions and (ii) an exit port for allowing the ions to exit the ionization space; and anode means, disposed in the ionization space, for discharging electrons in the electron beam from the ionization space once the electrons in the electron beam have passed through the ionization space.

Electron multipliers can be processed in such a way as to spontaneously produce a stream of electrons when a high voltage is applied. The use of an electron multiplier (such as a microchannel plate, discrete dynode, or single-channel electron multiplier) as the source of electrons would provide a much larger area of high current density in which to produce ions. In this fashion, significant increases in ionization efficiency can be realized.

In addition to producing a large area electron beam with high current density, an electron multiplier based electron source does not require the warm-up period and provides a longer useful lifetime.

The variations in standard manufacturing processes described above can be capitalized upon to produce noisy electron multipliers which can be used to produce a stream of electrons for electron impact ionization sources. Process variations suitable for producing spontaneous emission electron multipliers can be used in the invention, as will be described in greater detail below. The noisy electron multiplier is in contrast to the quiet electron multiplier of White et al.

The electron source according to the present invention is self-starting and does not require an external source to initiate or control the emission. In addition, such an electron source operates both in and out of the ion feedback mode, as is required for all analytical instrumentation operation, thus providing fine emission control.

BRIEF DESCRIPTION OF THE DRAWINGS

An embodiment of the present invention will now be set forth in detail with reference to the drawings, in which:

FIG. 3 shows a second embodiment of the ionization source for ensuring monoergic electron energy according to the present invention;

FIG. 5 shows a portion of another microchannel plate electron source for the ionization source of FIG. 2 or FIG. 3;

FIG. 6 shows an ionization source having a single-channel electron multiplier tube;

FIG. 7 shows an ionization source having discrete dynodes;

FIG. 8 shows two microchannel plates in a chevron configuration;

FIG. 9 shows two microchannel plates in a Z stack configuration;

FIG. 10 shows emission current from a chevron in ion runaway, the chevron configuration having a 5 $\mu$m pore size;

FIG. 11 shows the emission current in amperes as a function of applied voltage in kV for a single MCP, a chevron configuration, and a Z stack configuration;

FIGS. 12 and 13 show the emission current in amperes as a function of the applied voltage in kV in greater detail for the chevron configuration and the Z stack configuration, respectively;

FIG. 16 shows the emission current as a function of applied voltage for a Z stack configuration and a pore size of 5 $\mu$m after 144 hours of operation.

DETAILED DESCRIPTION OF THE INVENTION

Figure 1:
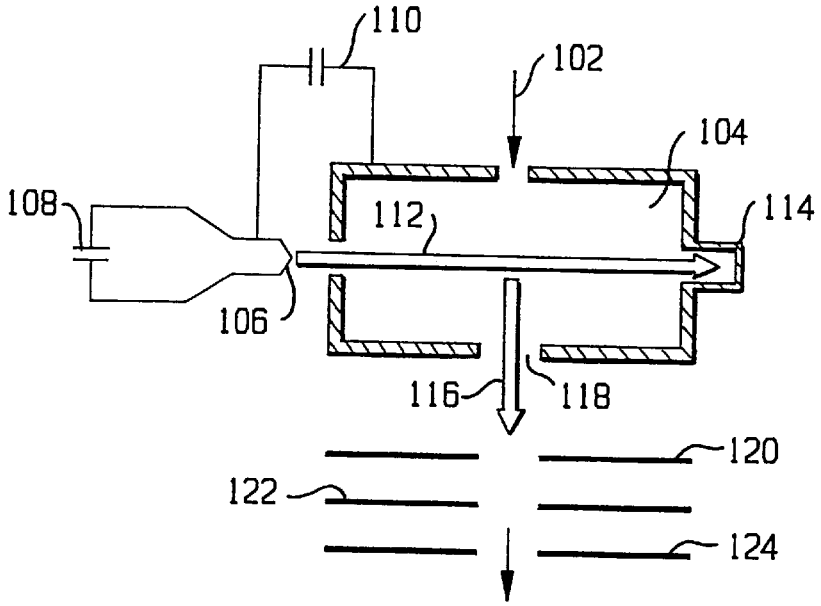
FIG. 1 (PRIOR ART)
FIG. 1 shows a filament-based ionization source according to the prior art.
Figure 2:
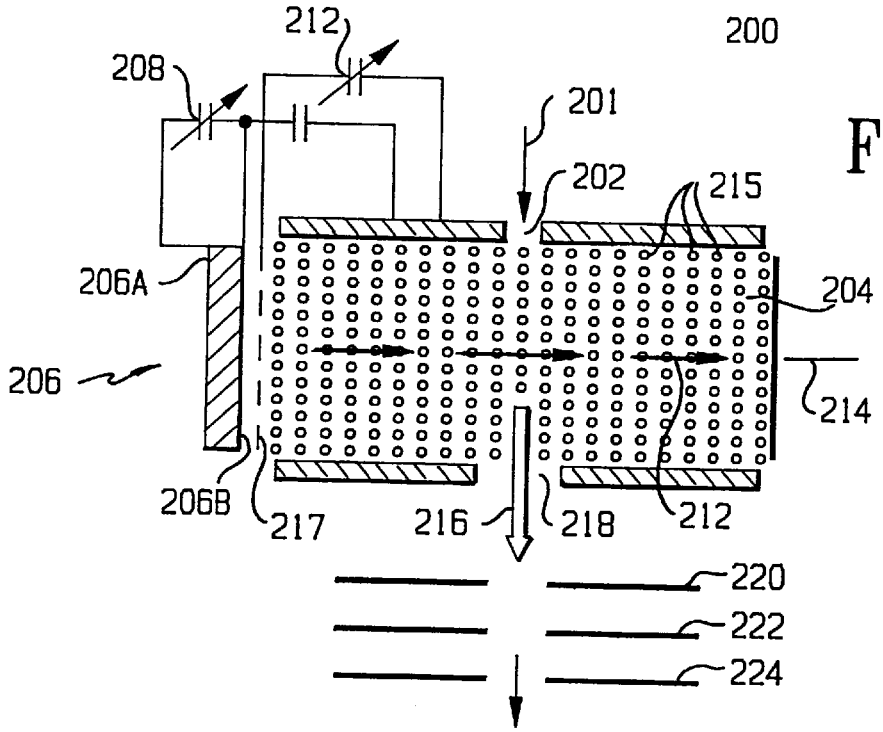
FIG. 2 shows a first embodiment of the ionization source according to the present invention.

An ionization source in accordance with a first embodiment of the invention is shown in FIG. 2. In this embodiment example, a specially processed microchannel plate is positioned at the beginning of an ionization cavity to serve as an electron source. The manner of special processing will be described in detail below.

As shown in FIG. 2, in ionization source 200, the material to be ionized is introduced via gaseous sample inlet 202 to ionization space 204. Microchannel plate (MCP) 206 used as an electron source has input and output faces 206A, 206B respectively. Microchannel plate electron source 206 is supplied with emission current supply voltage 208 between input face 206A and output face 206B. As a result, microchannel plate 206 emits a wide beam of electrons 215 along electron trajectory 212 to electron discharge anode 214. The beam 215 of electrons ionizes the material 201 to produce ion beam 216 which exits ionization space 204 through ion exit port 218. Ion beam 216 passes through extracting lens 220, focusing lens 222 and accelerating lens 224 to the analyzer (not shown).

Application of a high voltage to the input surface 206A of microchannel plate 206 by emission current supply voltage 208 initiates the emission of electrons from output surface 206B of microchannel plate 206. Varying the voltage across microchannel plate 206 varies the emission current of beam 215; the emission current is roughly proportional to the applied voltage. Other than application of the voltage, no special start-up step is required.

A series of grids 217 located adjacent to output surface 206B of MCP 206 and connected to electron energy supply 210 is used to establish the impact energy of the electrons (typically 70 volts) and thus to establish the exit electron energy from MCP 206. As the large-area electron beam 215 traverses the ionization space 204, impact with the ambient molecules will result in the production of positive ions. Increasing the pressure within ionization space 204, increasing the emission current, or doing both will increase ion production.

The ionization space is constructed as a closed, conductive chamber bounded by the MCP and the anode. Voltage 208 is connected between input side 206A of MCP 206 and ionization space 204. Voltage 212 is connected between grids 217 and ionization space 204.

A second embodiment of an ionization source according to the present invention has a tunable electron source shown in FIG. 3. Ionization source 300 in FIG. 3 is in many ways similar to ionization source 200 of FIG. 2. That is, in ionization source 300, the material 301 to be ionized is introduced via gaseous sample inlet 302 to ionization space 304. MCP 306, supplied with emission current supply voltage 308 and electron energy supply 310 voltage, emits a wide beam of electrons 315 along electron trajectory 312 to electron discharge anode 314. The beam of electrons ionizes the material to produce ion beam 316 which exits ionization space 304 through ion exit port 318. Ion beam 316 passes through extracting lens 320, focusing lens 322 and accelerating lens 324 to the analyzer (not shown).

However, ionization source 300 also includes high-energy electron discriminator 330 including voltage source 331 and electrode 332 and low-energy electron discriminator 334 including voltage source 335, grid 336 and case 337. Electrons leaving microchannel plate 306 travel past electrode 332 of high-energy electron discriminator 330. Those electrons whose energy is below a first level, determined by the voltage applied to electrode 332, follow trajectories 336*a* toward ionization space 304. Those electrons whose energy is above the first level follow trajectories 336*b* away from ionization space 304. Low-energy electrons following trajectories 336*a* are incident on the grid 336, which has a potential applied to it by the low-level energy discriminator 334 to form an energy barrier. Those electrons having energies above a second level determined by the grid. potential pass through grid 336 into ionization space 304. Those electrons having energies below the second level do not pass through the grid 336.

Thus, electrons whose energies lie in a band between the first and second levels enter ionization space 304, while all others are rejected. When the potentials applied by electron discriminators 330 and 334 are varied, the band changes. Thus, the electron source in ionization source 300 is tunable.

Continuous electron multipliers such as MCP 206 or 306 can be made by various methods to emit electrons spontaneously when a high voltage is applied. Variations in the manufacturing processes which cause the emissive surface of the first strike conversion area (the area where, in conventional microchannel plates, the electron entering the channel would be incident and where the first electron multiplication would take place) to field emit free electrons will effectively transform the electron multiplier into an electron source.

Single-channel electron multipliers and microchannel plates can be made to perform as spontaneous electron sources by subjecting the in-process device to an extended acid leaching step prior to the hydrogen reduction operation. As shown in the flow chart of FIG. 4, step 404 of acid leaching is performed between step 402 of forming the microchannel plate and step 406 of hydrogen reduction, with steps 402 and 406 being performed through any suitable techniques such as those known in the art. Spontaneous electron emission may be obtained by these devices with any acid leaching process such as hydrochloric, acetic, nitric, or sulfuric acid solution of more than about 1% (by volume) for an exposure time exceeding about one minute, at a temperature above about 20 degrees centigrade.

A second method for converting electron multipliers into spontaneous electron sources, as shown in FIG. 5, is achieved by coating the known first strike conversion surface 504 of a channel 502 in microchannel plate 500 with any alkali-containing compound 506 which will serve to lower the work function of the surface sufficiently to cause spontaneous electron emission. This approach will work for discrete dynode emitters as well as spontaneous electron emitters.

Figure 4:
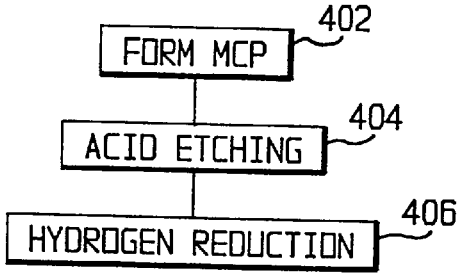
FIG. 4 shows a flow chart of a process used to produce a microchannel plate electron source for the ionization source of FIG. 2 or FIG. 3.

Of course, the methods of FIGS. 4 and 5 are illustrative rather than limiting. Any technique for causing an electron multiplier to act as a spontaneous electron source can be used in the present invention.

According to the invention, the ionization source or microchannel plate herein disclosed can be replaced by a single-channel electron multiplier, a discrete dynode multiplier, or other electron multiplier. Any electron multiplier having a source of spontaneously emitted electrons will suffice. Another possible variation is to use not a single MCP, but multiple MCP's in series. The MCP's can be arranged in a known chevron or Z configuration. Only the first MCP in the series is required to provide spontaneous electron emission.

Some such variations are shown in FIGS. 6-9. These figures show schematic diagrams; those skilled in the art will appreciate that working embodiments may look different. For example, electron sources are shown as discrete for the sake of clarity, although they may be formed integrally with other components in manners such as those described above. Also, electrical connections are not shown, since those skilled in the art will readily understand where such electrical connections should be introduced.

FIG. 6 shows an ionization source 600 including an electron source 602 and a single-channel electron multiplier tube 604. An electron e leaving the source 600 enters the tube 602 and hits a wall, releasing more electrons. This process is repeated many times, so that a single electron e gives rise to multiple electrons e' emerging from the far end of the tube 602 from the source 600.

FIG. 7 shows an ionization source 700 including an electron source 702 and discrete dynodes 704, 706, 708, . . . An electron e leaving the source 700 hits a dynode 704, which releases more electrons. This process is repeated for each of dynodes 706, 708, and so on, so that a single electron e gives rise to multiple electrons e' emerging from the last dynode. While only three dynodes are shown, those skilled in the art will know how many to provide for proper operation in any application.

FIGS. 8 and 9 show two configurations of two MCP's in series. FIG. 8 shows MCP's 802 and 804 in a chevron configuration, while FIG. 9 shows MCP's 902 and 904 in a Z stack configuration. Of course, if more than two MCP's are used, they may be in a chevron, Z stack, or mixed configuration.

Experimental results will now be set forth with reference to FIGS. 10–16.

FIG. 10 shows ion runaway for a chevron configuration with a 5 $\mu$m pore size. The emission current caused by ion runaway begins at a chevron voltage of 2 kV and exceeds 10 $\mu$A at less than 2.3 kV.

FIG. 11 shows the emission current in amperes as a function of applied voltage in kV for a single MCP, a chevron configuration, and a Z stack configuration, each having a 5 $\mu$m pore size. In all three configurations, the emission current varies roughly linearly with the applied voltage. FIGS. 12 and 13 show the emission current in amperes as a function of the applied voltage in kV in greater detail for the chevron configuration and the Z stack configuration, respectively.

Figure 14:
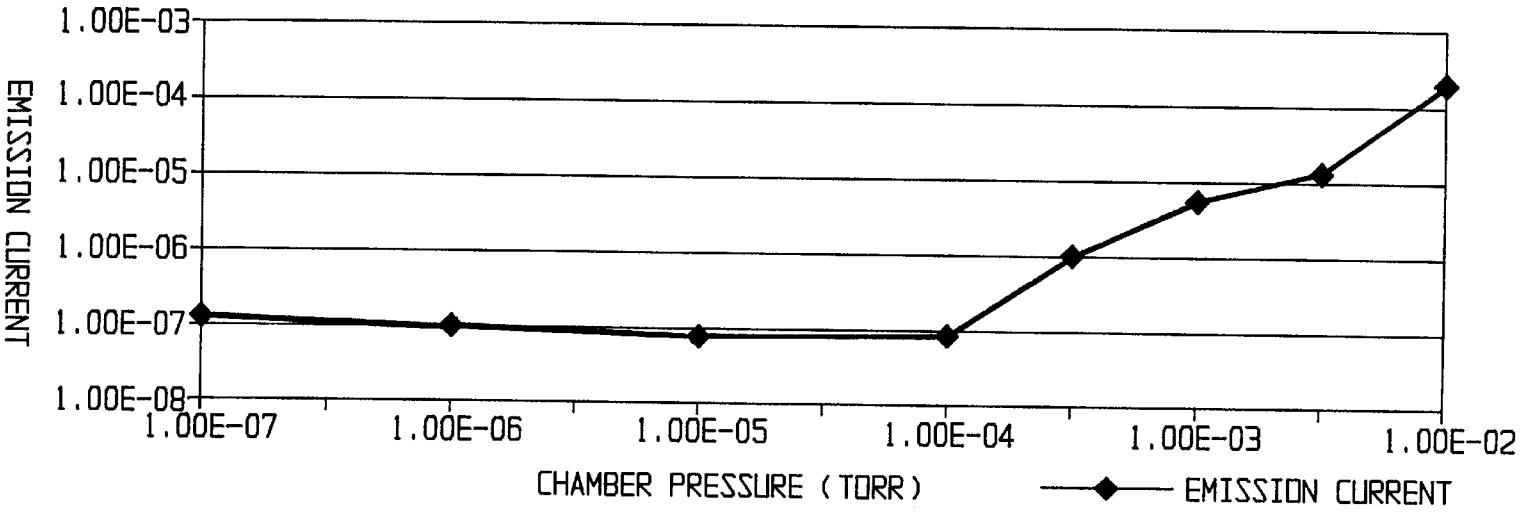
FIG. 14 shows the ion source emission current as a function of backfill argon chamber pressure.
Figure 15:
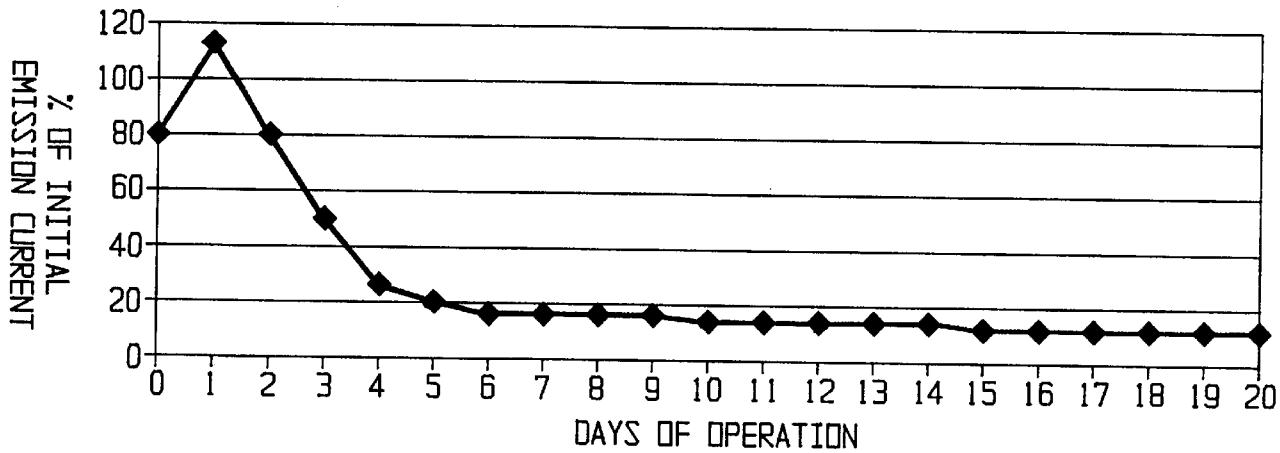
FIG. 15 shows the percentage of initial emission current over time for no feedback and argon at $5\times10^{-5}$torr.

FIG. 14 shows the ion source emission current as a function of backfill argon chamber pressure. FIG. 15 shows the percentage of initial emission current over time for no feedback and argon at $5\times10^{-5}$ torr. The emission current peaks at one day of operation and asympototically approaches a value of less than 20% of initial emission current. After 144 hours of operation, the emission current as a function of applied voltage for a Z stack configuration and a pore size of 5 $\mu$m is shown in FIG. 16.

While two embodiments of the invention have been set forth in detail, those skilled in the art will recognize that other embodiments can be realized within the scope of the invention. In addition to the modifications of the electron source described above, the electron source can be tuned in any suitable way. Also, the material to be ionized can be introduced directly into the multiplier. The MCP electron source can be used in settings other than the ionization source; for example, a cathode-ray tube can be made thin (around 2 mm) by using an MCP as large as the desired display as the electron gun. Modifications described separately can be combined.

I claim:

1. An electron source comprising:

at least one microchannel plate (MCP) including:

an electron generating portion comprising a field emission surface of the MCP for spontaneously generating source electrons in response to an applied electric field above a selected level; and an electron multiplying portion of the MCP responsive to the source electrons spontaneously generated by the generating portion, for multiplying the source electrons to produce an output electron beam.

2. An electron source as in claim 1, wherein the microchannel plate has at least one channel formed with a surface and wherein the generating portion and the electron multiplying portion are formed on the surface.

3. An electron source as in claim 1, wherein the generating portion comprises an acid-etched portion of the channel.

4. An electron source as in claim 1, wherein the generating portion comprises an alkali-containing compound disposed on a first strike surface of the at least one microchannel plate.

5. An electron source as in claim 1, wherein the at least one microchannel plate comprises a plurality of microchannel plates.

6. An electron source as in claim 5, wherein the plurality of microchannel plates are in a Z stack configuration.

7. An electron source as in claim 5, wherein the plurality of microchannel plates are in a chevron configuration.

8. An electron source as in claim 2, wherein the generating portion and the electron multiplying portion are integrally formed in a common portion of the channel.

9. An electron source as in claim 1, wherein the electron multiplying portion comprises a microchannel plate.

10. An electron source as in claim 1, wherein the electron generating portion comprises a microchannel plate.

11. An electron source as in claim 1, wherein the electron generating portion produces electrons solely in response to an applied electric field.

12. An electron source as in claim 1, wherein the electron generating portion produces electrons in the absence of an external stimulus including charged particles and electromagnetic radiation.

13. An electron source as in claim 1, wherein the microchannel plate has input and output faces and an electrode disposed on each surface connectable to a source of voltage for establishing the electric field for the electron generating portion.

14. The electron source as in claim 1, wherein the surface includes at least one of a hydrogen reduced portion and an acid etched portion.

15. The electron source as in claim 14, wherein the acid etched portion and the hydrogen reduced portion overlap.

16. The electron source as in claim 2, wherein the surface includes an alkali containing compound.

17. The electron source as in claim 1, wherein the electron multiplier comprises a plurality of discrete dynodes.

18. The electron source as in claim 1, wherein the electron multiplier comprises a single channel electron multiplier.

19. The electron source as in claim 1, wherein the applied electric field is variable for varying the electrons generated.

* * * * *